US010060716B2

(12) United States Patent
Creedican et al.

(10) Patent No.: US 10,060,716 B2
(45) Date of Patent: Aug. 28, 2018

(54) EXPLOSIVES MANIPULATION USING ULTRASOUND

(71) Applicants: Matthew Creedican, Arlington, WA (US); Sohan V. Mikkilineni, Boston, MA (US)

(72) Inventors: Matthew Creedican, Arlington, WA (US); Sohan V. Mikkilineni, Boston, MA (US)

( * ) Notice: Subject to any disclaimer, the term of this patent is extended or adjusted under 35 U.S.C. 154(b) by 77 days.

(21) Appl. No.: 14/556,505

(22) Filed: Dec. 1, 2014

(65) Prior Publication Data

US 2016/0161233 A1 Jun. 9, 2016

(51) Int. Cl.

| | |
|---|---|
| ***C06C 9/00*** | (2006.01) |
| ***F42B 33/06*** | (2006.01) |
| ***F41H 13/00*** | (2006.01) |
| ***F42D 5/04*** | (2006.01) |
| ***G10K 11/34*** | (2006.01) |

(52) U.S. Cl.

CPC ..... *F42B 33/06* (2013.01); *F41H 13/0081* (2013.01); *F42D 5/04* (2013.01); *G10K 11/346* (2013.01); *G10K 11/348* (2013.01)

(58) Field of Classification Search

CPC ..... F42B 33/06; F41H 13/0081; F42D 5/04; G10K 11/346; G10K 11/348

USPC ..... 102/205

See application file for complete search history.

(56) References Cited

U.S. PATENT DOCUMENTS 3,766,635 A * 10/1973 Cranston ..... B23K 20/085 228/108
3,780,654 A * 12/1973 Shimizu ..... G08C 23/02 102/215
3,811,380 A * 5/1974 Glass ..... F02K 9/94 102/287
4,037,538 A * 7/1977 Andrews ..... F42C 15/32 102/210
4,685,396 A * 8/1987 Birse ..... F42D 1/055 102/200
6,281,492 B1 * 8/2001 Almesangker ..... G10K 11/26 250/251
6,487,950 B2 * 12/2002 Samland ..... F41H 11/12 89/1.11
7,206,257 B1 * 4/2007 Meng ..... F41H 13/0081 361/1
7,505,368 B2 * 3/2009 Hamilton ..... F41H 11/02 367/137
7,624,667 B2 * 12/2009 Kilkis ..... F41H 11/12 102/402
8,397,813 B2 * 3/2013 Brandsdal ..... E21B 33/134 166/192
9,242,708 B2 * 1/2016 Cuschieri ..... B63G 7/08

(Continued)

FOREIGN PATENT DOCUMENTS

CN 105271232 A * 1/2016
WO WO 2014023863 A1 * 2/2014 ..... A23L 3/30

*Primary Examiner* — Michelle Clement
(74) *Attorney, Agent, or Firm* — Seattle Patent Group LLC; James Haugen

(57) ABSTRACT

The instant application discloses, among other things, devices and techniques for using high-intensity focused ultrasound (HIFU) for detonation of explosives. In one embodiment, a device configured to hold small, disposable, ultrasonic transducer arrays suitable for disposal, detonation, or other manipulation of explosives and hazardous materials is provided.

4 Claims, 8 Drawing Sheets

(56) References Cited

U.S. PATENT DOCUMENTS

| | | | | |
|---|---|---|---|---|
| 2008/0117718 | A1* | 5/2008 | Hamilton | F41H 11/02 367/137 |
| 2009/0107758 | A1* | 4/2009 | Moore | G01N 33/227 181/141 |
| 2009/0194744 | A1* | 8/2009 | Adebimpe | A01K 15/02 252/408.1 |
| 2010/0290979 | A1* | 11/2010 | Ackermann | B01J 3/08 423/447.1 |
| 2014/0072836 | A1* | 3/2014 | Mills | C25B 1/04 429/8 |
| 2015/0160181 | A1* | 6/2015 | White | G01S 7/411 702/22 |
| 2015/0167438 | A1* | 6/2015 | Rey-Bethbeder | E21B 43/26 166/248 |
| 2015/0241187 | A1* | 8/2015 | Reid | F42B 33/06 86/49 |
| 2016/0015652 | A1* | 1/2016 | John | B01J 13/22 424/490 |
| 2016/0086680 | A1* | 3/2016 | Filler | G21G 1/10 60/203.1 |
| 2016/0161233 | A1* | 6/2016 | Creedican | F41H 13/0081 102/205 |
| 2016/0220850 | A1* | 8/2016 | Tyler | A61N 7/00 |
| 2016/0223310 | A1* | 8/2016 | Morris | F42C 13/06 |

* cited by examiner

EXPLOSIVES MANIPULATION USING ULTRASOUND

FIELD

This disclosure relates generally to explosives manipulation using ultrasound.

BACKGROUND

Detonation of explosives is traditionally performed with a combination of heat and pressure, created by a chain of chemical mixtures that result in a high heat and pressure explosion. Donor materials used to generate heat and pressure are often dangerous to store and transport.

SUMMARY

The instant application discloses, among other things, devices and techniques for using high-intensity focused ultrasound (HIFU) for detonation or other manipulations of explosives. In one embodiment, a device including small, disposable, ultrasonic transducer arrays and a driver-controller suitable for the disposal, detonation, or other manipulations of explosives and hazardous materials is provided.

Placing an ultrasonic emitter having an array of transducers on an explosive device may allow pressure and heat generated by HIFU and resulting cavitation to degrade, detonate, or change the structure of the explosive. This technique may be used provide donor-explosive-free detonation of insensitive munitions (IM) and insensitive high explosives (IHE).

In HIFU, ultrasonic energy may be focused to a small spot within a material to heat the material to a temperature sufficient to create a desired effect. Applying this technique to modify the material to effect chemical interactions may involve a larger degree of complexity than simple heating. To achieve reliable results in chemical interaction, factors such as acoustic absorption, grain and crystal structure, multi-interface, pass through, absorption, multi-path interference, multi-path constructive and destructive wave interactions, and real-time change and phase assessment of the material may be considered. Rapid and distinct variation of the waves may also be key in successful chemical catalytic reactions. A plurality of transducer heads with a feedback system may help guide an operator to optimize placement of transducers for a particular material and a particular goal, as well as providing feedback during operation to a controlling device, allowing alteration of frequency, phase, and amplitude to be made in real time.

Cavitation may also be a means to induce detonation or restructuring of material. For example, if the detonation of insensitive high explosives is desired, the cavitation effect may be used to complete the chemical explosive reaction by creating points of high heat and pressure within the explosive. In one embodiment, this may be done after local heating of the area by HIFU or another means, depending on the explosive material. For example, at liquefaction but before a large change due to vaporization has taken place, the transducer array output may be modified to induce cavitation, which may induce a high order explosion in the material. In another embodiment, cavitation may be effected at lower temperatures and at lower intensities to degrade the material, such as in an explosive train, so that, for example, a blasting cap may be reduced, which may render a munition safe. In another embodiment, such as in sensitive explosives, cavitation may be undesirable as it may set off the explosive when instead it may only need to be evaluated or burned and or detonated in a low order as opposed to high order detonation. This may be controlled by a volume heated and points within that volume heated further using HIFU. By heating a small area and inducing a small local explosion a low order detonation may be achieved as only a small amount of explosive is releasing its energy, below a threshold to achieve a self-sustaining explosive heat/pressure wave. Conversely, heating a larger area and detonating at a multitude of points may cause a larger self-sustaining explosion, which may cause a high order detonation.

Ultrasonic cooling or alternating heating and cooling may also affect changes in a material.

DETAILED DESCRIPTION

Figure 1:
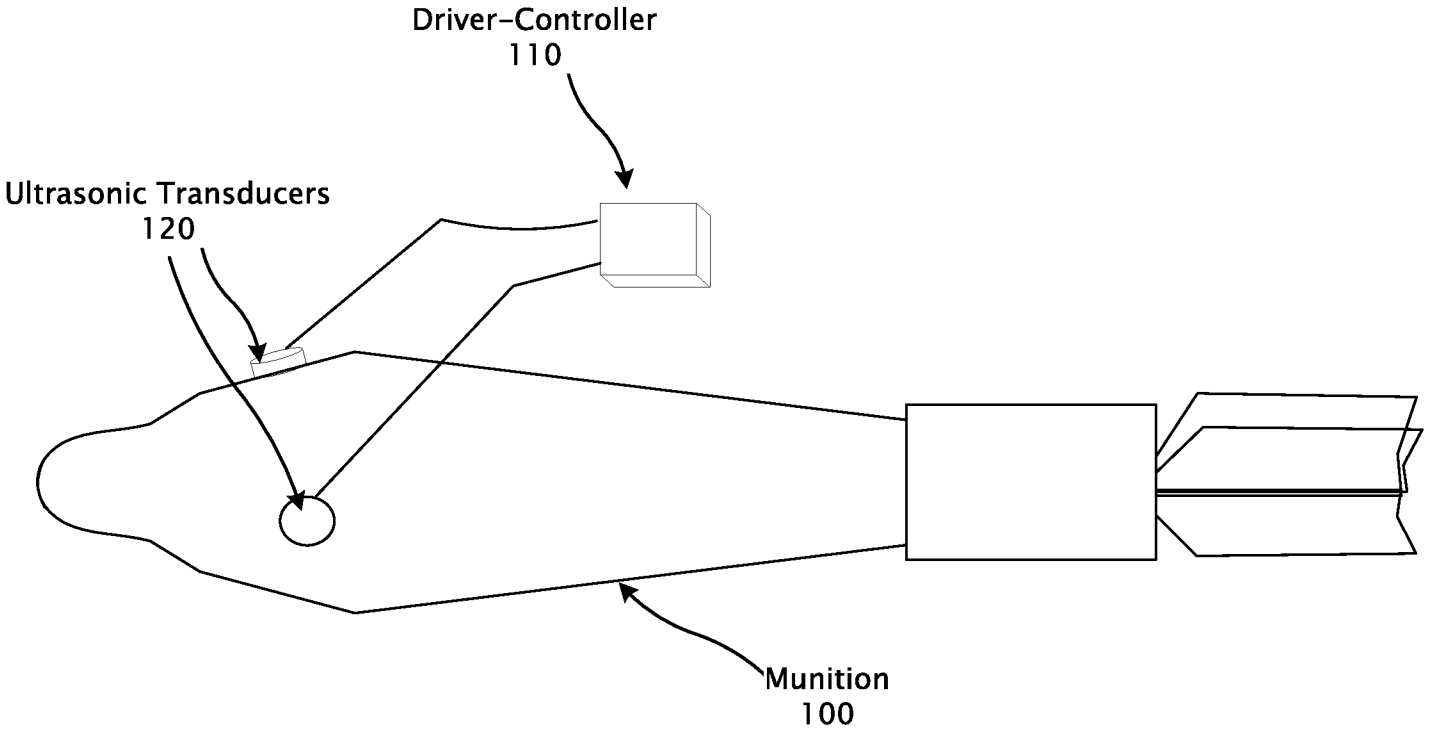
FIG. 1 is an illustration of an array of ultrasonic transducers on an explosive device, according to one embodiment.

A more particular description of certain embodiments of Selective Heating of Material with HIFU may be had by references to the embodiments described below, and those shown in the drawings that form a part of this specification, in which like numerals represent like objects.

HIFU heating may be conducted using an ultrasonic emitter having an array of transducers. The transducers may be actuated with a drive signal to emit ultrasonic waves at a selected frequency. Differences in phase may be applied to the drive signal sent to each transducer so that generated ultrasonic waves reinforce one another constructively at a focal location.

Application of intense ultrasonic energy to material may cause a phenomenon called "cavitation" in which small bubbles form and collapse. The occurrence of cavitation at any point within the material depends upon factors including the local temperature at that point, the composition of the material at that point and the characteristics of the ultrasonic energy applied to that point.

FIG. 1 is an illustration of an array of ultrasonic transducers on Munition 100. Driver-Controller 110 may control Ultrasonic Transducers 120, by adjusting amplitude and frequency of waves produced. Driver-Controller 110 may also receive feedback from Ultrasonic Transducers 120 or other sources, and use the feedback to determine optimal frequency and amplitude to use for a desired effect, which may be heating or cooling.

Similar techniques may allow control of formation and grain structure of material by controlling a heating or cooling rate of material to create different crystal grain structures, for example, annealing. Using similar ultrasound methods, flow and mixing of the material may be induced by creating standing waves or by creating hot and cold relative spots within the material. This technique could also be applied after an explosive has been poured, and may be used as a maintenance procedure for long term solid rocket motors, for example. One having skill in the art will recognize that there may be multiple uses of these and similar techniques.

Driver-Controller 110 may receive sonar-type feedback from the transducers, for example, which may allow it to map and dynamically determine an effective plan for detonation.

Various numbers of transducers may be used, depending on the type of device being destroyed, the types of transducers, performance requirements, or other factors.

Casing thickness of Munition 100 may not impact HIFU, particularly when the casing is an effective conductor of sound, which is true of most metals.

One having skill in the art will recognize that various types of ultrasonic transducers may be used, for example, micro-electromechanical systems (MEMS) or polymeric piezoelectric contact transducer crystals.

Figure 2:
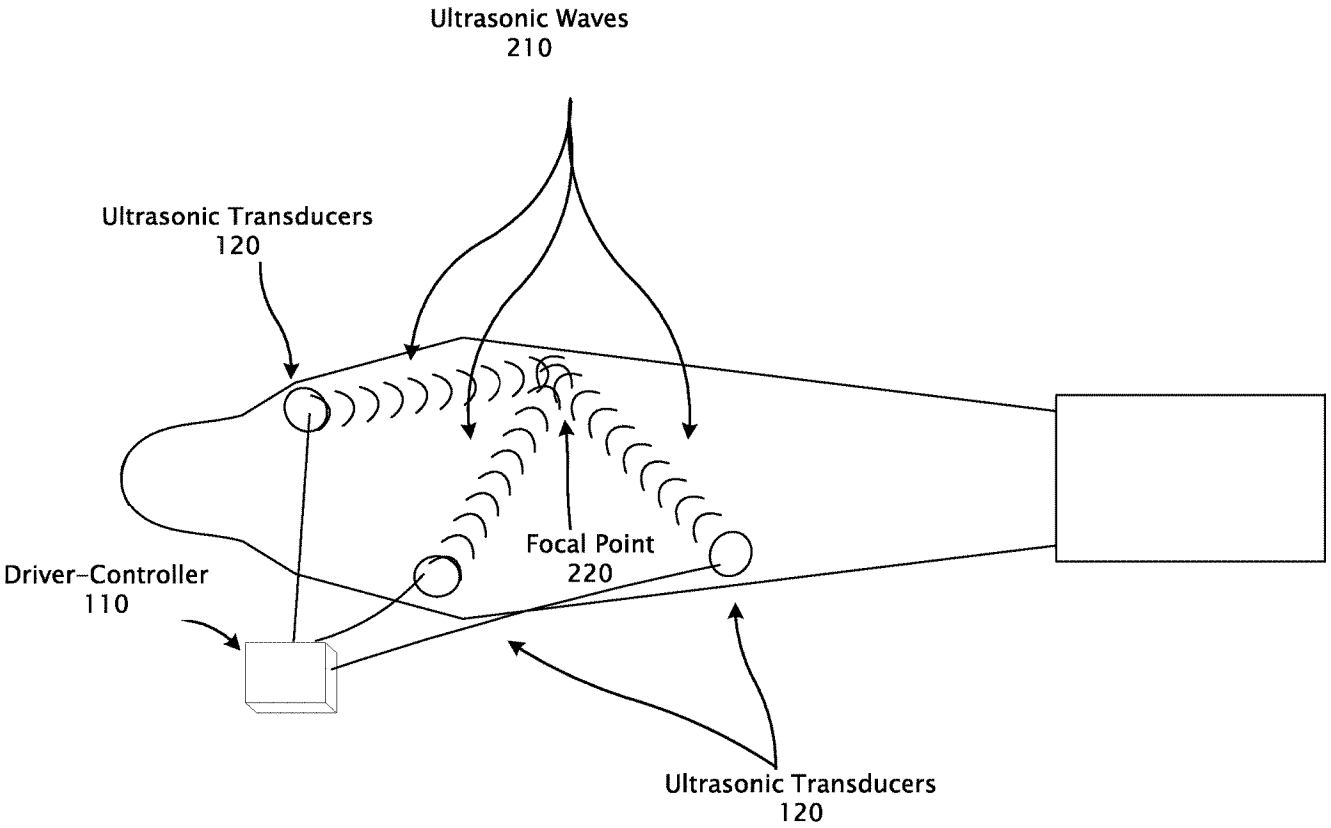
FIG. 2 illustrates using multiple sources of ultrasonic waves to focus energy in one location, according to one embodiment.

FIG. 2 illustrates using multiple sources of ultrasonic waves to focus energy in one location. Ultrasonic Transducers 120 may be aimed so Ultrasonic Waves 210 produced intersect at Focal Point 220, which may allow control of a temperature and pressure at Focal Point 220.

Driver-Controller 110 may receive feedback, which may allow it to determine if phase, frequency, or other adjustments should be made to produce a desired effect. Various factors may be considered to make such a determination, for example: acoustic absorption, grain and crystal structure, multi-interface, pass through, absorption, multi-path interference, multi-path constructive and destructive wave interactions, and real-time change and phase assessment of the material. Some of these factors may change as physical properties, such as temperature and pressure within a device change. Driver-Controller 110 may use ongoing feedback to adjust parameters over time. Feedback may be received, for example, from a feedback control circuit, analyzing input from sensors detecting reflected ultrasonic waves. Ultrasonic waves reflected from a target may be used for time reversal signal processing and may allow focusing the ultrasonic waves effectively. Feedback may also include whether cavitation is occurring.

Driver-Controller 110 may also use feedback to determine one or more optimal focal points to achieve a desired effect. This may allow lower precision to be used when applying Ultrasonic Transducers 120 to a device.

Figure 3:
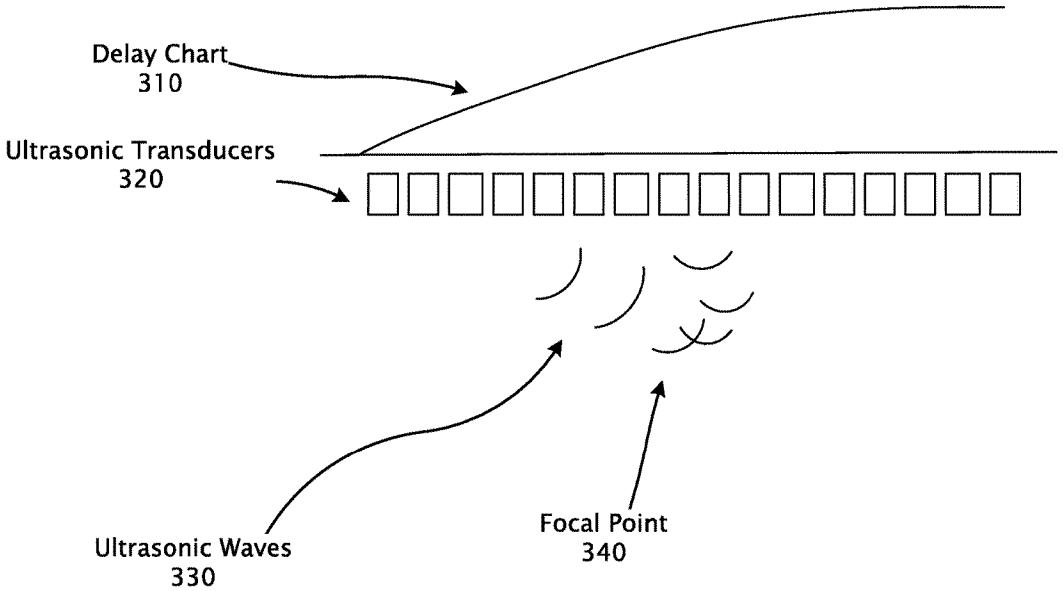
FIG. 3 illustrates formation of a focal point from a flat phased array of ultrasonic transducers, according to one embodiment.

FIG. 3 illustrates formation of a focal point from a flat phased array of Ultrasonic Transducers 320, according to one embodiment. Ultrasonic Transducers 320 may allow for electronic steering of a wave front, which may allow Focal Point 340 to be effectively made. Ultrasonic Waves 330 may be generated by Ultrasonic Transducers 320. By delaying driving Ultrasonic Transducers 320 non-linearly, for example according to Delay Chart 310, constructive interference patterns may be created, which may provide a cohesive angle-steered wave front.

Figure 4:
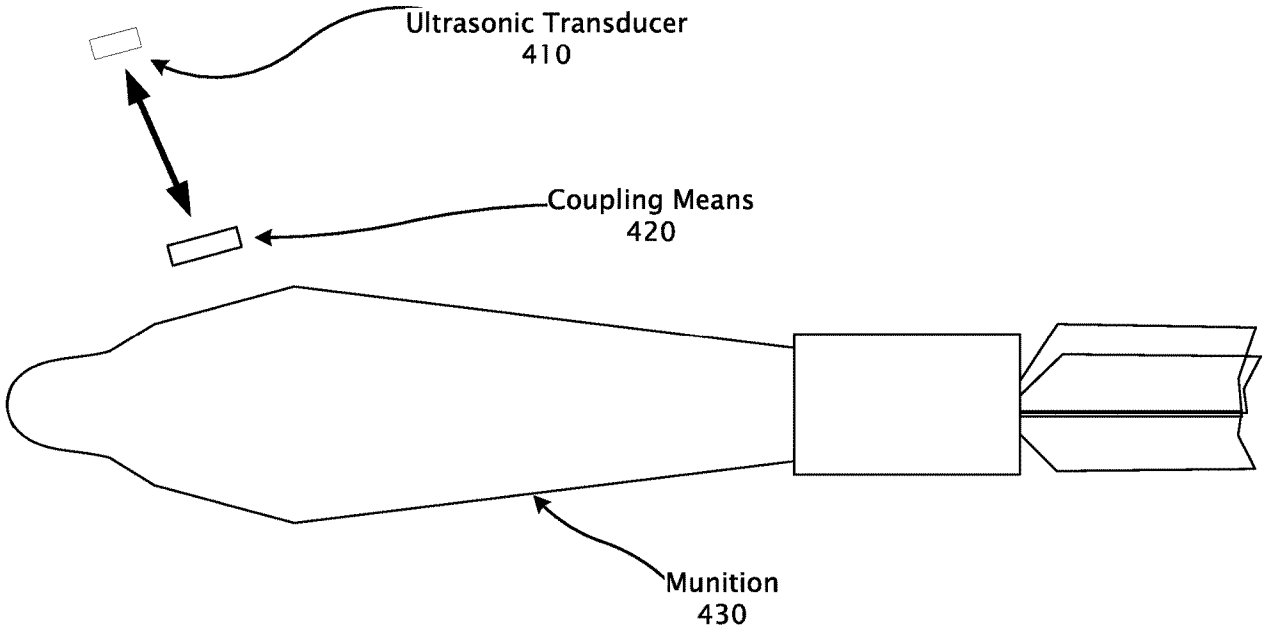
FIG. 4 illustrates a coupling means to couple an ultrasonic transducer array to a munition, according to one embodiment.

FIG. 4 illustrates Coupling Means 420 to couple Ultrasonic Transducer Array 410 to Munition 430, according to one embodiment. Coupling Means 420 may allow, for example, flat-surfaced Ultrasonic Transducer Array 410 to be coupled with a rounded surface on a casing of Munition 430. Ultrasonic Transducer Array 410 and Munition 430 may be similar in acoustic impedance. For optimal performance, acoustic impedance for Ultrasonic Transducer Array 410, Coupling Means 420, and the casing on Munition 430 may be closely matched.

Several techniques may be used to detonate or destroy an IM or IHE device. One technique is to generate a hot spot within the device, which may cause it to detonate. Another technique is to heat explosives within the device evenly and significantly, which may cause the device to detonate. Another technique is to heat explosives within the device evenly and significantly, but not to the point of detonating, and finalize detonation by spot-heating a small volume, which may cause detonation.

Figure 5:
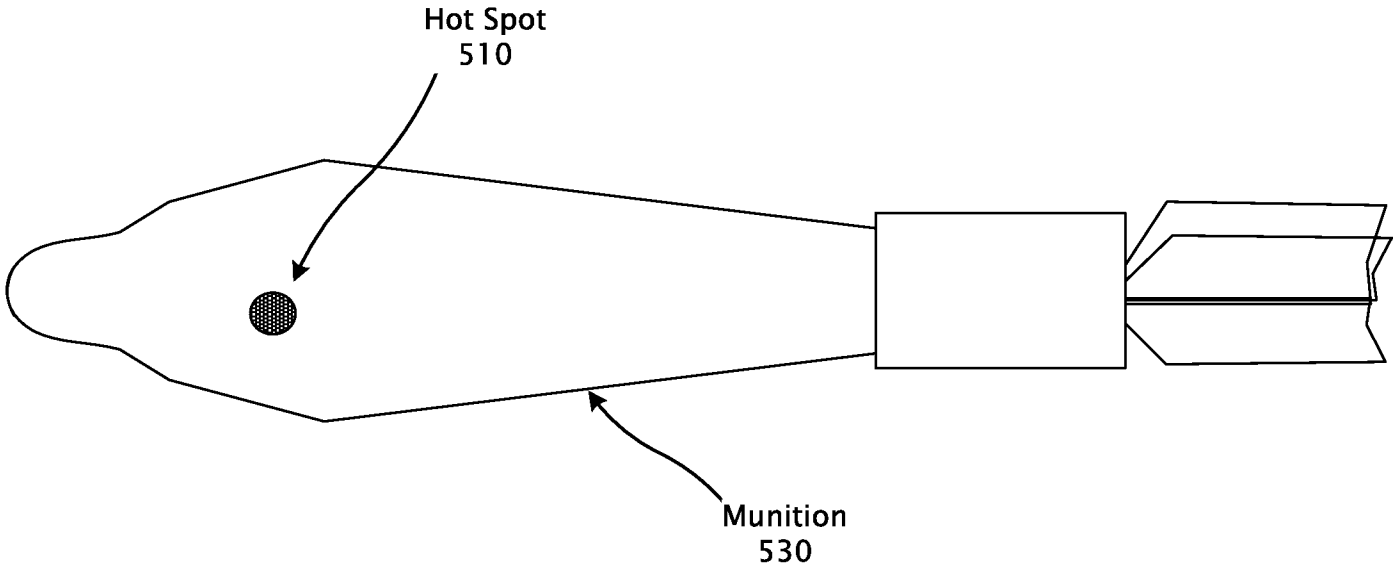
FIG. 5 illustrates spot heating, according to one embodiment.

FIG. 5 illustrates spot heating, according to one embodiment. Several techniques may be used to detonate or destroy an IM or IHE device. One technique is to generate a hot spot within the device, which may cause it to detonate. This may be done by selecting a focal point for heating, which may generate Hot Spot 510. Hot Spot 510 may be heated until Munition 530 detonates.

Figure 6:
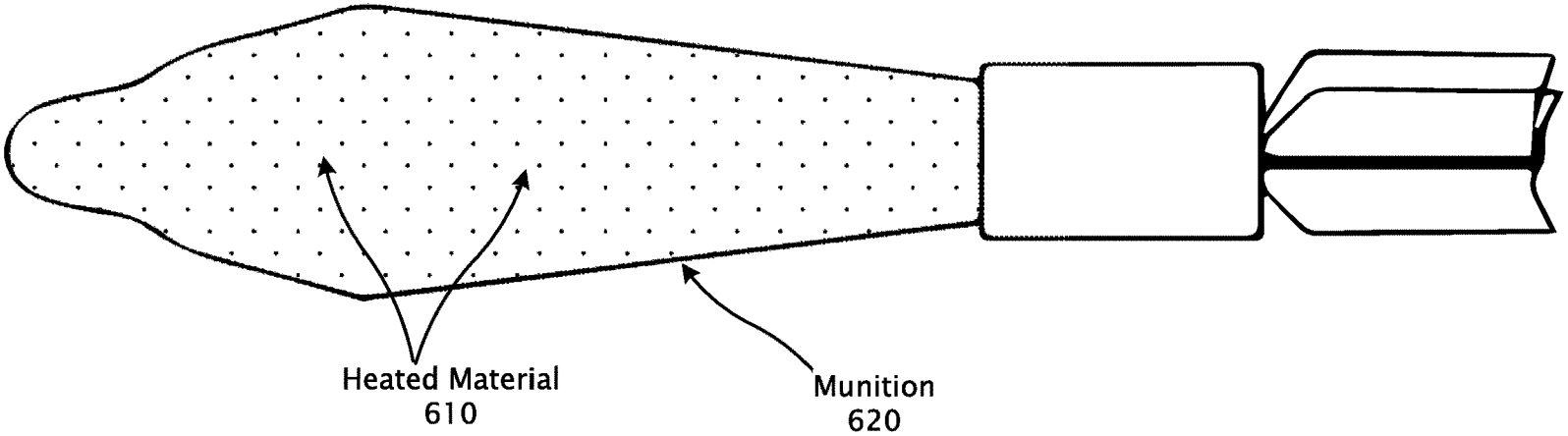
FIG. 6 illustrates general heating, according to one embodiment.

FIG. 6 illustrates general heating, according to one embodiment. In this embodiment, Heated Material 610 within the device may be heated evenly, which may cause Munition 620 to detonate.

Figure 7:
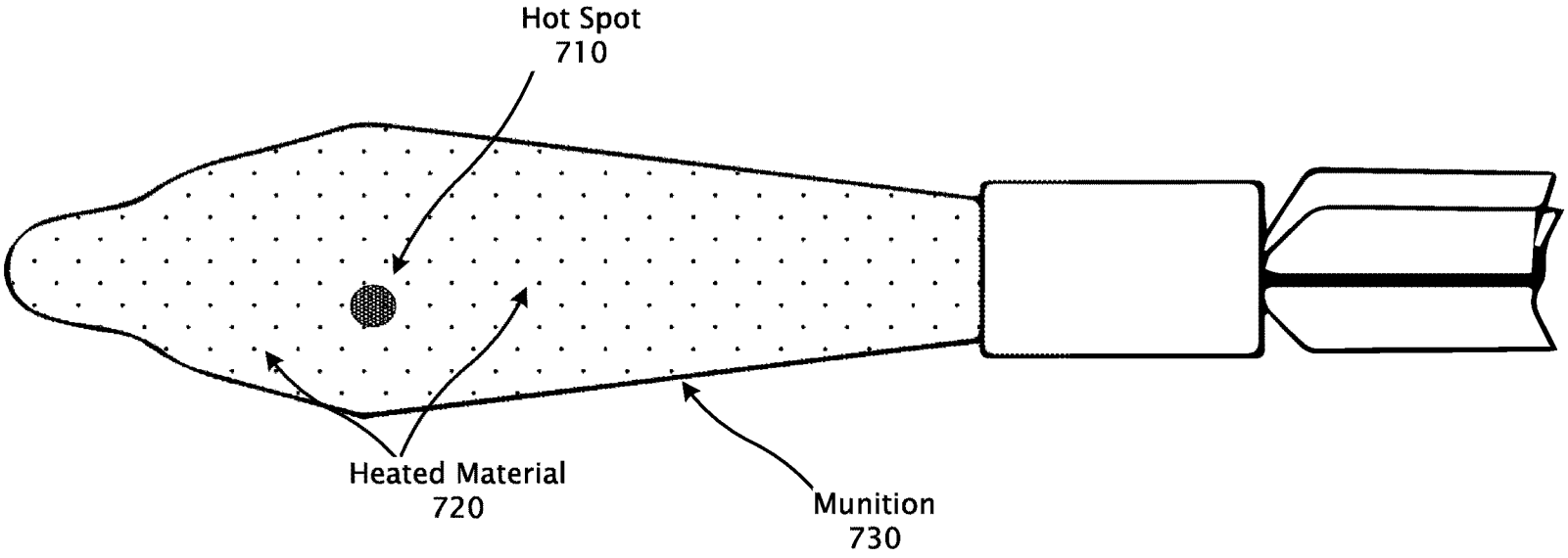
FIG. 7 illustrates general and spot heating, according to one embodiment.

FIG. 7 illustrates general and spot heating, according to one embodiment. In this embodiment, Heated Material 710 within the device may be heated evenly and significantly, but not to the point of detonating, and detonation may be accomplished by spot-heating a small volume, Hot Spot 710. Hot Spot 710 may exploit the heated state of Heated Material 720, which may cause Munition 730 to explode.

Figure 8:
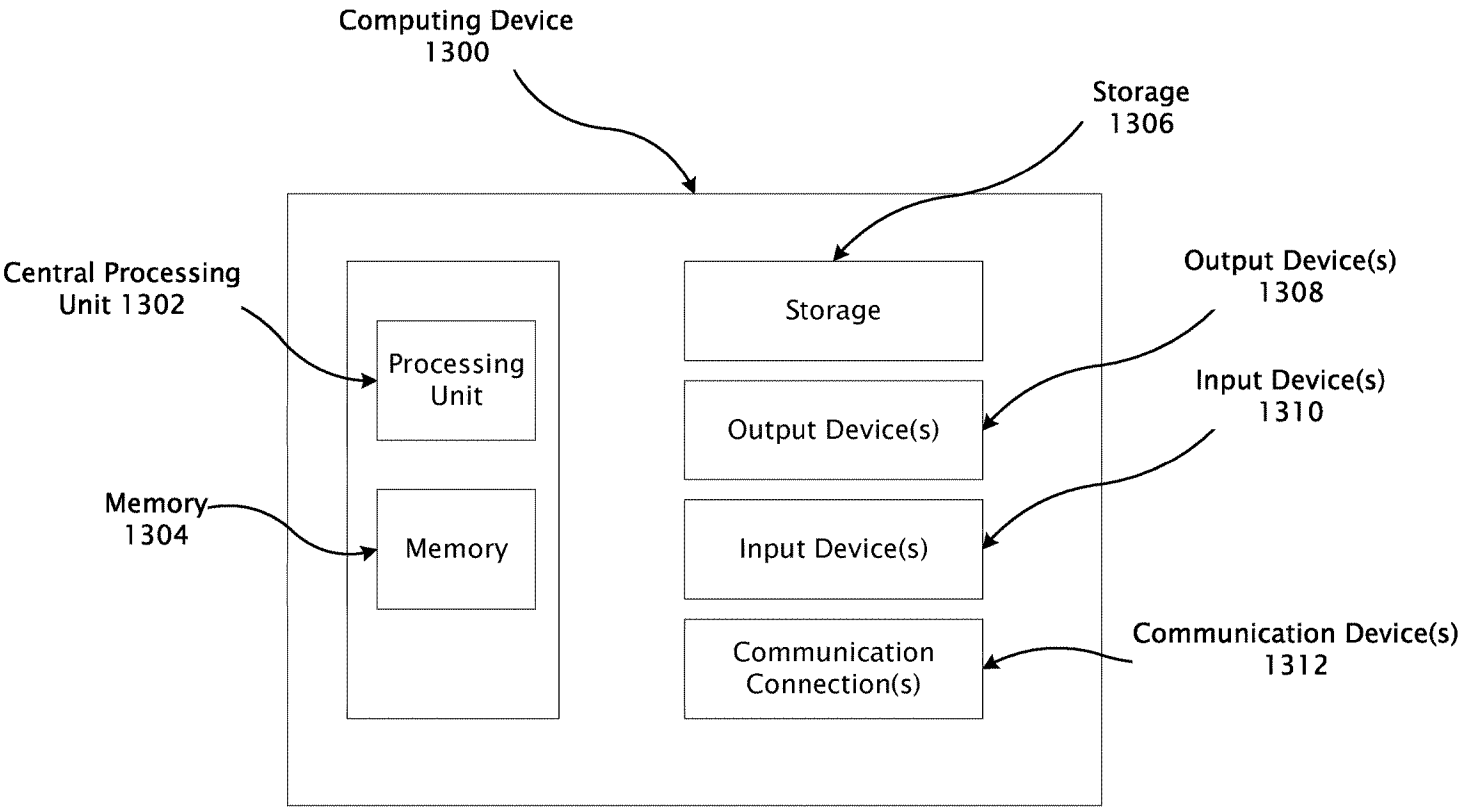
FIG. 8 illustrates a component diagram of a computing device according to one embodiment.

FIG. 8 illustrates a component diagram of a computing device according to one embodiment. The Computing Device (1300) can implement one or more computing devices, computer processes, or software modules described herein, including, for example, but not limited to Driver-Controller 110. In one example, the Computing Device (1300) can process calculations, execute instructions, receive and transmit digital signals. In another example, the Computing Device (1300) can process calculations, execute instructions, receive and transmit digital signals, receive and transmit search queries, and hypertext, compile computer code as required by Driver-Controller 110. The Computing Device (1300) can be any general or special purpose computer now known or to become known capable of performing the steps and/or performing the functions described herein, either in software, hardware, firmware, or a combination thereof.

In its most basic configuration, Computing Device (1300) typically includes at least one Central Processing Unit (CPU) (1302) and Memory (1304). Depending on the exact configuration and type of Computing Device (1300), Memory (1304) may be volatile (such as RAM), non-volatile (such as ROM, flash memory, etc.) or some combination of the two. Computing Device (1300) may also have additional features/functionality. For example, Computing Device (1300) may include multiple CPU's. The described methods may be executed in any manner by any processing unit in computing device (1300). For example, the described process may be executed by both multiple CPU's in parallel.

Computing Device (1300) may also include additional storage (removable and/or non-removable) including, but not limited to, magnetic or optical disks or tape. Such additional storage is illustrated in FIG. 5 by Storage (1306).

Computer readable storage media include volatile and non-volatile, removable and non-removable media implemented in any method or technology for storage of information such as computer-readable instructions, data structures, program modules or other data. Memory (1304) and Storage (1306) are all examples of computer storage media. Computer readable storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can store the desired information and which can accessed by computing device (1300). Any such computer-readable storage media may be part of computing device (1300). Computer readable storage media do not include transient signals.

Computing Device (1300) may also contain Communications Device(s) (1312) that allow the device to communicate with other devices. Communications Device(s) (1312) is an example of communication media. Communication media typically embody computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency (RF), infrared and other wireless media. The term computer-readable media as used herein includes both computer storage media and communication media. The described methods may be encoded in any computer-readable media in any form, such as data, computer-executable instructions, and the like.

Computing Device (1300) may also have Input Device(s) (1310) such as keyboard, mouse, pen, voice input device, touch input device, etc. Output Device(s) (1308) such as a display, speakers, printer, etc. may also be included. All these devices are well known in the art and need not be discussed at length.

Those skilled in the art will realize that storage devices utilized to store program instructions can be distributed across a network. For example, a remote computer may store an example of the process described as software. A local or terminal computer may access the remote computer and download a part or all of the software to run the program. Alternatively, the local computer may download pieces of the software as needed, or execute some software instructions at the local terminal and some at the remote computer (or computer network). Those skilled in the art will also realize that by utilizing conventional techniques known to those skilled in the art that all, or a portion of the software instructions may be carried out by a dedicated circuit, such as a digital signal processor (DSP), programmable logic array, or the like.

While the detailed description above has been expressed in terms of specific examples, those skilled in the art will appreciate that many other configurations could be used.

Accordingly, it will be appreciated that various equivalent modifications of the above-described embodiments may be made without departing from the spirit and scope of the invention.

The foregoing description of various embodiments of the invention has been presented for the purposes of illustration and description. It is not intended to be exhaustive or to limit the invention to the precise form disclosed. It is intended that the scope of the invention be limited not by this detailed description, but rather by the claims appended hereto. The above specification, examples, and data provide a complete description of the manufacture and use of the invention. Since many embodiments of the invention can be made without departing from the spirit and scope of the invention, the invention resides in the claims hereinafter appended.

The invention claimed is:

1. A method for manipulating an explosive using ultrasound heating, comprising:

selecting a first area within the explosive to manipulate;

aiming a first ultrasonic transducer such that a first set of waves generated by the first transducer will reach the first area;

aiming a second ultrasonic transducer such that a second set of waves generated by the second transducer will reach the first area;

adjusting the first ultrasonic transducer or the second ultrasonic transducer such that the first set of waves and the second set of waves reinforce constructively at the first area; and operating the first ultrasonic transducer and the second ultrasonic transducer to heat or cool the area until the manipulation is accomplished, wherein the manipulation comprises cavitation.

2. A method for manipulating an explosive using ultrasound heating, comprising:

selecting a first area within the explosive to manipulate;

aiming a first ultrasonic transducer such that a first set of waves generated by the first ultrasonic transducer will reach the first area;

aiming a second ultrasonic transducer such that a second set of waves generated by the second ultrasonic transducer will reach the first area;

adjusting the first transducer or the second transducer such that the first set of waves and the second set of waves reinforce constructively at the first area;

operating the first ultrasonic transducer and the second ultrasonic transducer to heat or cool the area until the manipulation is accomplished;

monitoring ultrasonic waves reflected within the explosive; and using information collected during the monitoring to adjust parameters of the first ultrasonic transducer or the second ultrasonic transducer.

3. A method for manipulating an explosive using ultrasound heating, comprising:

selecting a first area within the explosive to manipulate;

aiming a first ultrasonic transducer such that a first set of waves generated by the first ultrasonic transducer will reach the first area;

aiming a second ultrasonic transducer such that a second set of waves generated by the second ultrasonic transducer will reach the first area;

adjusting the first ultrasonic transducer or the second ultrasonic transducer such that the first set of waves and the second set of waves reinforce constructively at the first area;

operating the first ultrasonic transducer and the second ultrasonic transducer to heat or cool the area until the manipulation is accomplished; and alternatively heating and cooling the first area.

4. The method of claim 3, further comprising alternatively heating and cooling a second area, the second area being different from the first area.

* * * * *